US006291941B1

(12) United States Patent
Zimlich et al.

(10) Patent No.: US 6,291,941 B1
(45) Date of Patent: Sep. 18, 2001

(54) METHOD AND CIRCUIT FOR CONTROLLING A FIELD EMISSION DISPLAY FOR REDUCING EMISSION TO GRID

(75) Inventors: David A. Zimlich; Thomas W. Voshell; David A. Cathey, Jr., all of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/261,589

(22) Filed: Mar. 3, 1999

Related U.S. Application Data

(63) Continuation of application No. 08/623,509, filed on Mar. 28, 1996, now Pat. No. 5,910,791, which is a continuation-in-part of application No. 08/509,501, filed on Jul. 28, 1995, now Pat. No. 5,721,560.

(51) Int. Cl.[7] ..... G09G 3/10

(52) U.S. Cl. ..... 315/169.1; 315/169.3; 315/337; 345/74; 345/76; 345/211; 345/212

(58) Field of Search ..... 315/167, 168, 315/169.1, 169.3, 337; 345/74, 76, 84, 211, 212, 214; 313/309, 351

(56) References Cited

U.S. PATENT DOCUMENTS

| | | | |
|---|---|---|---|
| 3,500,102 | 3/1970 | Crost et al. | 313/109 |
| 3,671,798 | 6/1972 | Lees | 313/356 |
| 4,874,981 | 10/1989 | Spindt | 313/309 |
| 4,908,539 | 3/1990 | Meyer | 315/169.3 |
| 5,093,654 | 3/1992 | Swift et al. | 340/781 |
| 5,210,472 | 5/1993 | Casper et al. | 315/349 |
| 5,212,426 | 5/1993 | Kane | 315/169 |
| 5,283,500 | 2/1994 | Kochanski | 315/58 |
| 5,359,256 | 10/1994 | Gray | 313/169 |
| 5,378,962 | 1/1995 | Gray et al. | 313/495 |
| 5,402,143 | 3/1995 | Ge et al. | 345/102 |
| 5,477,110 | 12/1995 | Smith et al. | 315/169.3 |
| 5,557,177 | 9/1996 | Engle | 315/366 |
| 5,581,159 | 12/1996 | Lee et al. | 315/167 |
| 5,638,085 | 6/1997 | Hush et al. | 345/74 |
| 5,638,086 | 6/1997 | Lee et al. | 345/74 |
| 5,656,892 | 8/1997 | Zimlich et al. | 315/169.3 |
| 5,708,451 * | 1/1998 | Baldi | 345/75 |
| 5,721,560 | 2/1998 | Cathey, Jr. et al. | 345/74 |

OTHER PUBLICATIONS

Notes on Using the Spindt–type Field Emission Cathode, Capp Spindt, SRI International, Menlo Park, CA, Oct., 1976.

Cathey, David A. Jr., "Field Emission Displays", published in VLSI, Taiwan, May–Jun., 1995.

* cited by examiner

*Primary Examiner*—Haissa Philogene
(74) *Attorney, Agent, or Firm*—Stephen A. Gratton

(57) ABSTRACT

A method and a control circuit for controlling a field emission display to reduce emission to grid during turn on and turn off are provided. In an illustrative embodiment, the control circuit includes a threshold detector that receives an input signal proportional to an anode voltage ($V_{Anode}$) for the display and produces a high or low output signal dependent on the level of $V_{Anode}$. An output low corresponding to a high voltage at the display screen enables a gate element of a pass transistor that controls current flow to the grid. Alternately, an output high corresponding to a low voltage at the display screen enables a pull down transistor that controls discharge of the grid to ground. The control circuit can also include a fault detection circuit for detecting a sharp decrease in the anode voltage and discharging the grid. In an alternate embodiment, the control circuit shorts the emitter sites together during turn on and turn off and provides a high source impedance to restrict current flow to any one emitter site. The high source impedance can be permanent or switchable by a relay or switching circuit.

15 Claims, 6 Drawing Sheets

METHOD AND CIRCUIT FOR CONTROLLING A FIELD EMISSION DISPLAY FOR REDUCING EMISSION TO GRID

CROSS REFERENCE TO RELATED APPLICATIONS

This application is a continuation of application Ser. No. 08/623,509, filed Mar. 28, 1996, now U.S. Pat. No. 5,910,791, which is a continuation-in-part of U.S. patent application Ser. No. 08/509,501 filed on Jul. 28, 1995, now U.S. Pat. No. 5,721,560.

This invention was made with Government support under Contract No. DABT63-93-C-0025 awarded by Advanced Research Project Agency ("ARPA"). The government has certain rights in this invention.

FIELD OF THE INVENTION

The present invention relates to field emission displays (FEDs) and to a method for reducing emission to grid during turn on and turn off of a field emission display.

BACKGROUND OF THE INVENTION

Flat panel displays have recently been developed for visually displaying information generated by computers and other electronic devices. These displays can be made lighter and require less power than conventional cathode ray tube displays. One type of flat panel display is known as a cold cathode field emission display a field emission display (FED).

A cold cathode FED uses electron emissions to illuminate a cathodoluminescent screen and generate an image. A single pixel 10 of a prior art FED is shown in FIG. 1A. The FED pixel 10 includes a substrate 11 formed with a conductive layer 12. An array of emitter sites 13 are formed on the conductive layer 12. Although each pixel 10 typically contains many emitter sites (e.g., 4–20 for a small display and several hundred for a large display), for simplicity only one emitter site 13 is shown in FIG. 1A. A grid 15 is associated with the emitter sites 13 and functions as a gate electrode. The grid 15 is electrically isolated from the conductive layer 12 by an insulating layer 18. The grid 15/conductive layer 12/substrate 11 subassembly is sometimes referred to as a baseplate.

Cavities 23 are formed in the insulating layer 18 and grid 15 for the emitter sites 13. The grid 15 and emitter sites 13 are in electrical communication with a power source 20. The power source 20 is adapted to bias the grid 15 to a positive potential with respect to the emitter sites 13. When a sufficient voltage differential is established between the emitter sites 13 and the grid 15, a Fowler-Nordheim electron emission is initiated from the emitter sites 13. The voltage differential for initiating electron emission is typically on the order of 20 volts or more.

Electrons 17 emitted at the emitter sites 13 collect on a cathodoluminescent display screen 16. The display screen 16 is separated from the grid 15 by an arrangement of electrically insulating spacers 22. The display screen 16 includes an external glass face 14, a transparent electrode 19 and a phosphor coating 21. Electrons impinging on the phosphor coating 21 cause the release of photons 25 which forms the image. The display screen 16 is the anode in this system and the emitter sites 13 are the cathode. The display screen 16 is biased by the power source 20 (or by a separate anode power source) to a positive potential with respect to the grid 15 and emitter sites 13. The potential at the display screen 16 is termed herein as anode. In some systems the potential at the display screen 16 is on the order of 1000 volts or more.

One method of addressing the emitter sites 13 for use in video displays is taught by Crost et al. in U.S. Pat. No. 3,500,102. In this method the emitter sites 13 are electrically connected and placed parallel to additional rows of emitter sites. The grids 15 associated with the emitter sites 13 are electrically connected in parallel columns which are orthogonal to the emitter rows. The emitter sites 13 associated with each pixel 10 of the FED are uniquely defined by the intersection point of a specific emitter row and a specific grid column. Electrically addressing a row while simultaneously addressing a column activates a specific pixel 10.

Another method for addressing the emitter sites 13 for use in video displays is disclosed by Casper et al. in U.S. Pat. No. 5,210,472. In this method, a common grid electrode is employed with respect to all of the pixels in the display. Addressing of the pixels within the display as taught by Casper et al. is accomplished with row and column electrodes which provide access for the emitter sites 13 to a source of electrons.

One problem in a FED that occurs during the turn on process (i.e., power up) is the emission of electrons from the emitter sites 13 to the grids 15. Emission to grid during turn on is illustrated in FIG. 1B. During the turn on process, electrons 26 emitted from the emitter sites 13 can go directly to the grid 15 rather than to the display screen 16. This situation can lead to overheating of the grids 15. The emission to grid can also affect the voltage differential between the emitter sites 13 and grids 15. In addition, desorped molecules and ions can be ejected from the grid 15 causing excessive wear of the emitter sites 13. Electron emission to grid can also lead to electrical arcing 30 between the grid 15 and the conductive layer 12 or emitter sites 13. In addition, electrons 26 emitted from the emitter sites 13 can strike the spacers 22 causing a charge build up on the spacers 22.

All of these problems decrease the lifetime, performance and reliability of the FED. Electron emission to grid is particularly a problem in consumer electronic products, such as camcorders, televisions and automotive displays, which are typically turned on and off many times throughout the useful lifetime of the product.

One reason for the electron emission to grid, is that electron emission may have commenced from the emitter sites 13 before the large voltage potential ($V_{Anode}$) has been established at the display screen 16. Typically, the display screen 16 is a relatively large, relatively high voltage structure which requires some period of time to reach full potential across its entire surface. In addition, the display screen 16 operates at a significantly higher voltage than any other component of the FED. Some period of time is required to ramp up to this operating voltage. Consequently, the display screen 16 can be at a low enough positive potential to allow electron emission to grid 15 to occur, as illustrated in FIG. 1B. Although this situation may only occur for a relatively short period of time, it can cause system problems as outlined above.

A related situation can also occur during turn on of the display screen 16 and grid 15 if the emitter sites 13 are not electrically controlled. If the emitter sites 13 are not limited during power on, an uncontrolled amount of emission can occur causing the same problems as outlined above.

In addition, a similar situation exists during the turn off process for the FED cell 10 (i.e., power off). If power to the large positive potential at the display screen 16 is lost prior to termination of electron emission from the emitter sites 13, then electron emission to grid, as illustrated in FIG. 1B, can occur.

In view of these problems associated with field emission displays, it is an object of the present invention to provide an improved method for controlling field emission displays to prevent electron emission to grid during turn on and turn off. It is yet another object of the present invention to provide an improved control circuit for an FED adapted to reduce electron emission to grid during turn-on and turn off. Other objects, advantages and capabilities of the present invention will become more apparent as the description proceeds.

SUMMARY OF THE INVENTION

In accordance with the present invention, an improved method and an improved control circuit for reducing electron emission to grid during turn on and turn off of a field emission display are provided. The control circuit includes a threshold detector, a level shifter, a pass transistor and a pull down transistor. In an illustrative embodiment the threshold detector can be a logical inverter. The inverter receives an input signal ($V_1$) that is proportional to the anode voltage ($V_{Anode}$) and provides an inverted output signal. An output low of the inverter, corresponding to a high voltage at the anode, enables the pass transistor and grid, provided that a voltage supply for the grid is above a certain level. An output high of the inverter, corresponding to a low voltage at the anode, enables the pull down transistor and discharges the grid through a power or ground bus.

Alternately, a Schmitt trigger or other threshold detector can be used in place of the inverter. With a Schmitt trigger the input signal ($V_1$) is received and an inverted output signal is provided only if the input signal ($V_1$) is above a predetermined value.

The control circuit can also include a fault detection circuit for detecting faults such as a voltage drop caused by noise. The fault detection circuit can include a second pass transistor in series with the first pass transistor and a second pull down transistor between the grid and power or ground bus. In addition, the fault detection circuit can include a comparator that receives a first input based on the anode voltage ($V_{Anode}$) and a second input based on the anode voltage ($V_{Anode}$) routed through a diode. With no fault detection (e.g., $V_{Anode}$ decays slowly), there is current through the diode. In this state, an output of the comparator remains low to enable the second pass transistor and allow current to flow to the grid, provided that the voltage supply to the grid is at a certain level. With fault detection (e.g., $V_{Anode}$ decreases sharply), the diode acts as a peak detector and retains the voltage before the noise occurred. In this state the output of the comparator goes hi to enable the second pull down transistor and discharge the grid through the ground or power bus. Once the fault goes away, the comparator goes low again and current to the grid is enabled. If an operator of the field emission display increases or decreases the anode voltage in order to make the display screen brighter or dimmer, the fault detection circuit follows without grid interruption.

In an alternate embodiment of the invention, power supply source impedance is utilized to prevent emission to grid. In this embodiment all of the emitter sites for the field emission display are shorted together in the "on"s condition. The power supply for the emitter sites can be constructed with a permanent high source impedance capable of driving only a limited number of emitter sites. Current to a single emitter site is thus limited and emission to grid cannot occur. Alternately the power supply can be constructed to operate in a high impedance mode with the emitter sites shorted together until the voltage at the grid ($V_g$) has been stabilized. In this case a switching arrangement, such as a relay or device switch, can switch the power supply between a high impedance for the turn on and turn off mode and a low impedance for an operational mode.

DETAILED DESCRIPTION OF THE PREFERRED EMBODIMENT

Figure 1A:
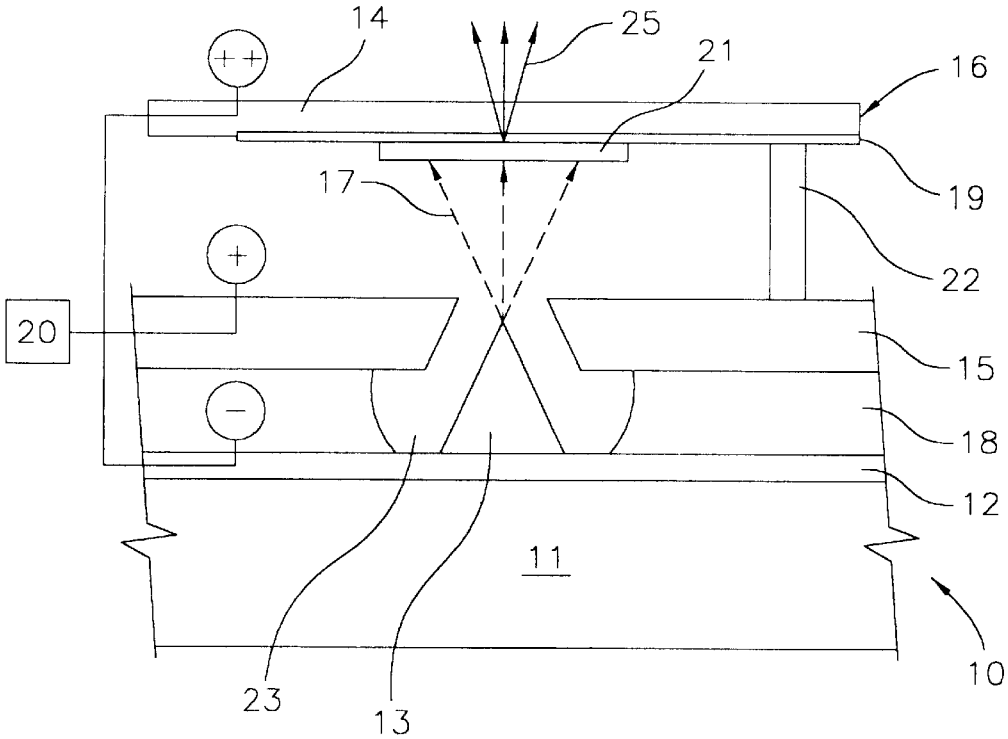
FIGURE 1A (PRIOR ART)
FIG. 1A is a schematic cross sectional view of a pixel of a prior art field emission display (FED)
Figure 1B:
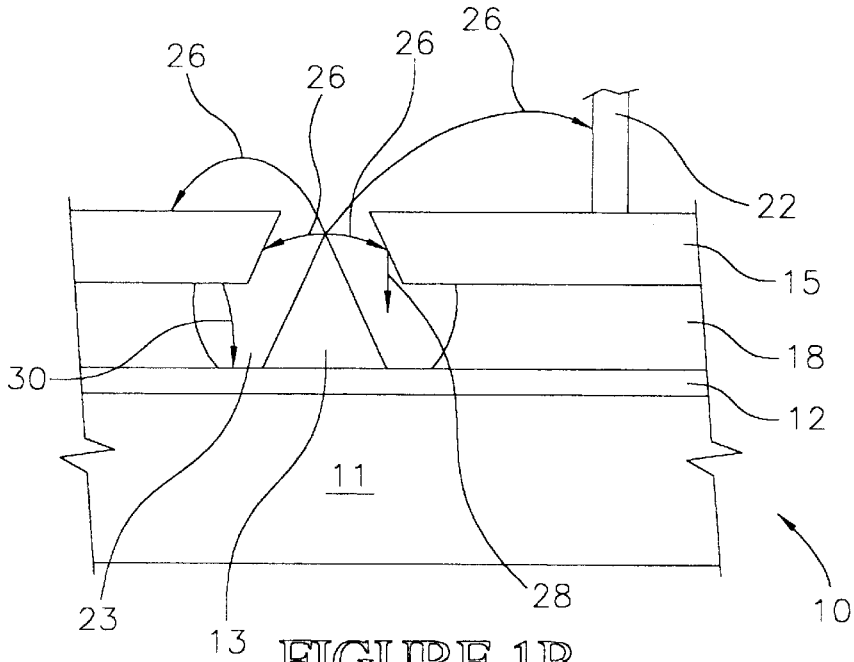
FIGURE 1B (PRIOR ART)
FIG. 1B is a schematic cross sectional view illustrating emission to grid occurring during turn on or turn off for the prior art field emission display shown in FIG. 1A.
Figure 2:
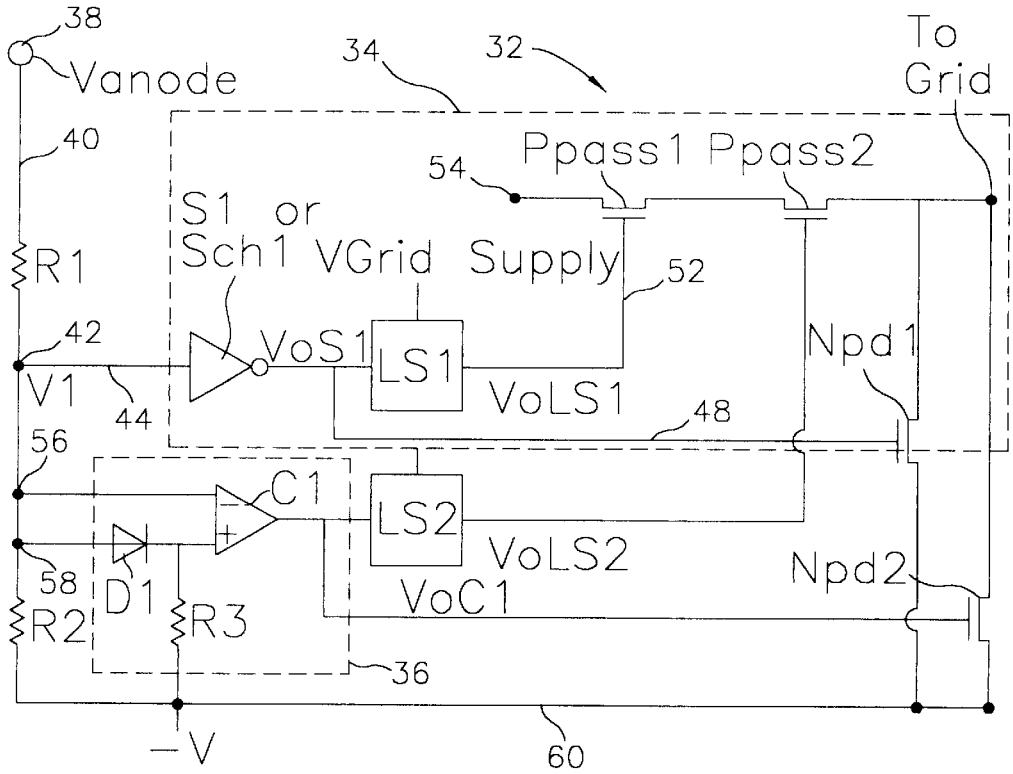
FIG. 2 is an electrical schematic of a control circuit constructed in accordance with the invention for controlling emission to grid during turn on and turn off of a field emission display.

With reference to FIG. 2, a control circuit 32 constructed in accordance with the invention is shown. The control circuit 32 includes an anode sensing circuit 34 and a fault detection circuit 36. The anode sensing circuit 34 is adapted to enable the grid 15 (FIG. 1A) when $V_{Anode}$ is "high" and to discharge the grid 15 when $V_{Anode}$ is "low". $V_{Anode}$ refers to the high voltage present at the display screen 16 (FIG. 1A). A high signal refers to an "on" or enabled condition and a low signal refers to an "off" condition. A transition between high and low is referred to as "disabling". The fault detection circuit 36 is adapted to discharge the grid 15 (FIG. 1A) if $V_{Anode}$ decreases sharply such as would occur with noise above a certain level. A sharp decrease is defined as a situation where a catastrophic or destructive mode could occur.

As shown in FIG. 2, $V_{Anode}$ is tapped at node 38. A conductive line 40 extends from node 38 through a resistor R1 to an input node 42 for the anode sensing circuit 34. $V_1$ is the voltage at input node 42. $V_1$ is proportional to $V_{Anode}$.

A conductive line 44 extends from the input node 42 into the anode sensing circuit 34. The anode sensing circuit 34 includes an inverter $S_1$ that receives its input signals from node 42. The inverter $S_1$ is a simple logical inverter (i.e., not gate) with one input and one output. If the input to inverter $S_1$ is high, the output $V_{OS1}$ is low. If the input to inverter $S_1$ is low, the output $V_{OS1}$ is high. In place of a simple logical inverter $S_1$, a Schmitt trigger $Sch_1$ can be used. The Schmitt trigger $Sch_1$ functions in substantially the same manner as the inverter $S_1$ but is actuated by a specified threshold or triggering voltage. The output voltage $V_{OS1}$ of the Schmitt trigger $Sch_1$ remains low until a specified threshold voltage is crossed then it is actuated.

The output of inverter $S_1$ (or Schmitt trigger $Sch_1$) is electrically communicated through a first conductive line 46 to a level shifter $LS_1$ and through a second conductive line 48 to a pull down transistor $N_{pd1}$ for the grid 15 (FIG. 1A). The level shifter $LS_1$ is a cell that boosts a signal that is proportional to $V_{GridSupply}$ where $V_{GridSupply}$ is the voltage for the power source for the grid 15 (FIG. 1A). Either one power source (e.g., 20 FIG. 1A) or separate power sources can be used for the display screen 16 (FIG. 1A) and for the grid 15 (FIG. 1A).

Figure 2A:
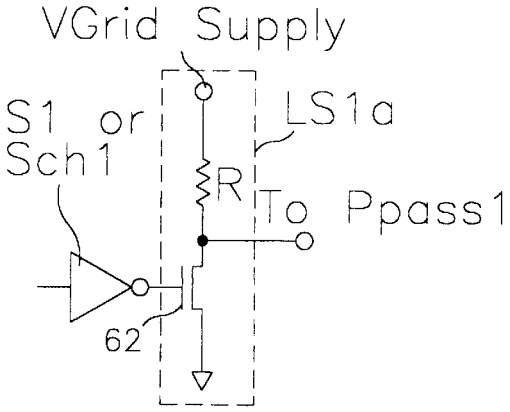
FIG. 2A is an electrical schematic of a first (A) embodiment for a level shifter component for the control circuit shown in FIG. 2.

The level shifter $LS_1$ provides an output signal $V_{OLS1}$ electrically communicated through conductive line 52 to a gate element of a pass transistor $P_{pass1}$. FIG. 2A illustrates an exemplary level shifter $LS_{1A}$ comprising an n-channel transistor 62 with its gate element controlled by $V_{OS1}$. The drain of transistor 62 is electrically connected to resistor R and to $V_{GridSupply}$. The source of transistor 62 is also electrically connect to $P_{PASS1}$. The drain of transistor 62 is electrically connected to ground. In the circuit of FIG. 2A, when the inverter $S_1$ switches low, it causes an inverter 72 within the level shifter $LS_{1A}$ to go high. This causes the n-channel transistor 62 to pull low. If the n-channel transistor 62 is sufficiently strong (relative to R) it will take the drain to ground. This causes $P_{pass1}$ to have a $-V_{qs}=V_{Grid}$.

Figure 2B:
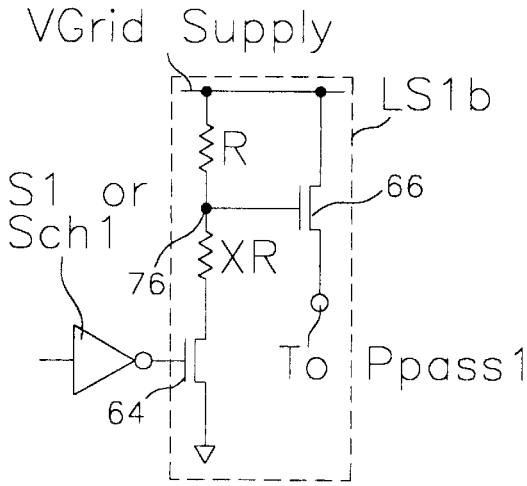
FIG. 2B is an electrical schematic of a second (B) embodiment for a level shifter component for the control circuit shown in FIG. 2.
Figure 2C:
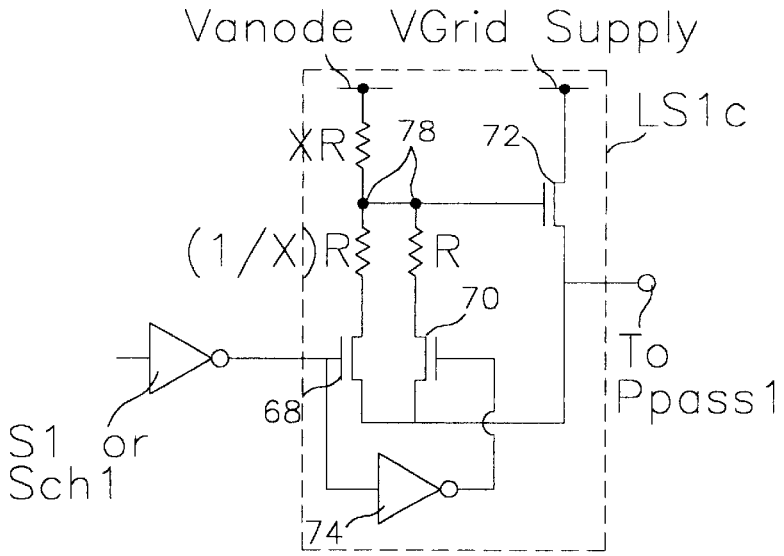
FIG. 2C is an electrical schematic of a third (C) embodiment for a level shifter component for the control circuit shown in FIG. 2.

FIGS. 2B and 2C illustrate exemplary level shifters $LS_{1B}$ and $LS_{1C}$ that enable $P_{pass1}$ and the grid only if a minimum grid voltage $V_{GridSupply}$ is being supplied. As shown in FIG. 2B, level shifter $LS_{1B}$ includes an inverter 72 electrically connected to $S_1$ (or $Sch_1$). The inverter 72 is in electrical communication with the gate of an n-channel transistor 64. A source of the n-channel transistor 64 is electrically connected through series resistors R and XR to $V_{GridSupply}$. The drain of n-channel transistor 64 is electrically connected to ground. In addition, level shifter $LS_{1B}$ includes a transistor 66 having a gate element electrically connected through a node 76 located between the series resistors R and XR. The source for the transistor 66 is electrically connected to $V_{GridSupply}$ and the drain is electrically connected to $P_{pass1}$.The circuit of FIG. 2B allows $-V_{qs}$ to be programmed by R and XR (i.e., a resistor divider), when the n-channel transistor 64 is on.

As shown in FIG. 2C level shifter $LS_{1C}$ is constructed as a zero power level translator. This circuit includes a pair of p-channel transistors 68, a pair of n-channel transistors 70, and an inverter 74. These elements are electrically connected substantially as shown to provide a zero power level translator. The level shifter $LS_{1C}$ allows level translation with no DC current path from supply to ground in steady state.

Referring again to FIG. 2, $P_{pass1}$ is electrically connected in series with a pass transistor $P_{pass2}$. The source of $P_{pass1}$ is electrically connected to an input node 54 that is $V_{GridSupply}$. The drain of $P_{pass1}$ is electrically connected to the source of $P_{pass2}$. The drain of $P_{pass2}$ is electrically connected to the grid 15 (FIG. 1A). The gate element of $P_{pass2}$ is electrically connected to the fault detection circuit 36 through $LS_2$.

With this arrangement, current to the grid 15 is controlled by $P_{pass1}$ and $P_{pass2}$. If $P_{pass1}$ is enabled by the anode sensing circuit 34 and $P_{pass2}$ is enabled by the fault detection circuit 36, then current can flow to the grid 15 (FIG. 1A).

Discharge of the grid 15 (FIG. 1A) to power bus or ground can be through a pull down transistor $N_{pd1}$ or through a pull down transistor $N_{pd2}$. A power bus 60 electrically connects the pull down transistors $N_{pd1}$ and $N_{pd2}$ to ground (V−) (or to the power bus). The gate element of pull down transistor $N_{pd1}$ is controlled by the anode sensing circuit 34. The gate element of pull down transistor $N_{pd2}$ is controlled by the fault detection circuit 36.

In a normal turn on mode, the display screen 16 (FIG. 1A) is enabled and $V_{Anode}$ goes high. Once $V_{Anode}$ reaches a certain threshold voltage and provided $V_{GridSupply}$ is at a certain threshold voltage, then $P_{pass1}$ is enabled by the sensing circuit 34 and current can flow to the grid 15 provided there is no fault detection. This threshold voltage for $V_{Anode}$ will normally be at a value of 100% of a "high" signal as the anode must be at 100% of minimum voltage to attract free electrons. For example, if $V_{ANODE\ NOMINAL}$ is 1000 v and $V_{ANODE\ MIN}$ is 800 v then a high signal can be 900 v. In a normal turn off mode, the display screen 16 is shut down and $V_{Anode}$ goes low. In this case $N_{pd2}$ is enabled by the sensing circuit 34 and the grid 15 is allowed to discharge to ground.

The fault detection circuit 36 includes a comparator $C_1$ that controls the gate element for pass transistor $P_{pass1}$ and the gate element for pull down transistor $N_{pd1}$. The comparator $C_1$ receives a negative input directly from node 56. Node 56 is at the same voltage $V_1$ as node 42 for the inverter $S_1$ and is connected to the power bus 60 through resistor $R_2$. In addition, the comparator $C_1$ receives a positive input from node 58 but with a diode $D_1$ placed between node 58 and the input to the comparator $C_1$. Node 58 is equivalent to node 56. The diode $D_1$ is also in electrical communication with the power bus 60 through resistor $R_3$. This limits the current through $D_1$ which controls the voltage across $D_1$.

The comparator $C_1$ functions as a fault detector. The comparator $C_1$ compares its two input signals and provides a high or low output signal based on the comparison. If there is current flow through the diode $D_1$, corresponding to a "no fault" condition, then the output of the comparator $C_1$ is at low and pass transistor $P_{pass2}$ is enabled. A level shifter $LS_2$ functions in the same manner as level shifter $LS_1$ previously described to prevent enabling of the pass transistor $P_{pass2}$ if $V_{GridSupply}$ is not at a predetermined level.

A fault corresponds to a noise spike such as a gun going off in the field. In this case $V_{Anode}$ will decrease rapidly and sharply. The diode $D_1$ acts as a peak detector and retains the voltage present prior to the noise occurring. In this state the output of the comparator $C_1$ goes high to enable the pull down transistor $N_{pulldown2}$ and discharge the grids 15. Once the fault subsides, comparator $C_1$ goes high again to enable $P_{pass2}$ and allow the grid 15 to go high. In this manner the grid 15 can begin to turn off in anticipation of a fault. The fault detection circuit 36 is optional as the sensing circuit 34 can function without fault detection.

The following truth table summarizes the operation of the sensing circuit 34 and fault detection circuit 36 with a level sensor $LS_1$ constructed as shown in FIG. 2C.

TRUTH TABLE

| $V_1$ | $V_{NOISE}$ | $V_{OS1}/N_{PD1}$ | $V_{OLS1}/P_{PASS1}$ | $V_{OC1}/N_{PD2}$ | $V_{OLS2}/P_{PASS2}$ | TO GRID |
|---|---|---|---|---|---|---|
| 0 | 0 | 1/ON | 1/OFF | LOW/OFF | LOW/ON | OFF |
| 0 | 1 | 0/OFF | 0/ON | LOW/OFF | LOW/ON | OFF |
| 1 | 0 | 0/OFF | 0/ON | 0/OFF | 0/ON | ON |
| 1 | 1 | 1/ON | 1/OFF | 1/ON | 1/OFF | OFF |

(With respect to $V_{NOISE}$, "1" means noise occurs and causes $V_1$ to be independent of $V_{Anode}$.)

Figure 3:
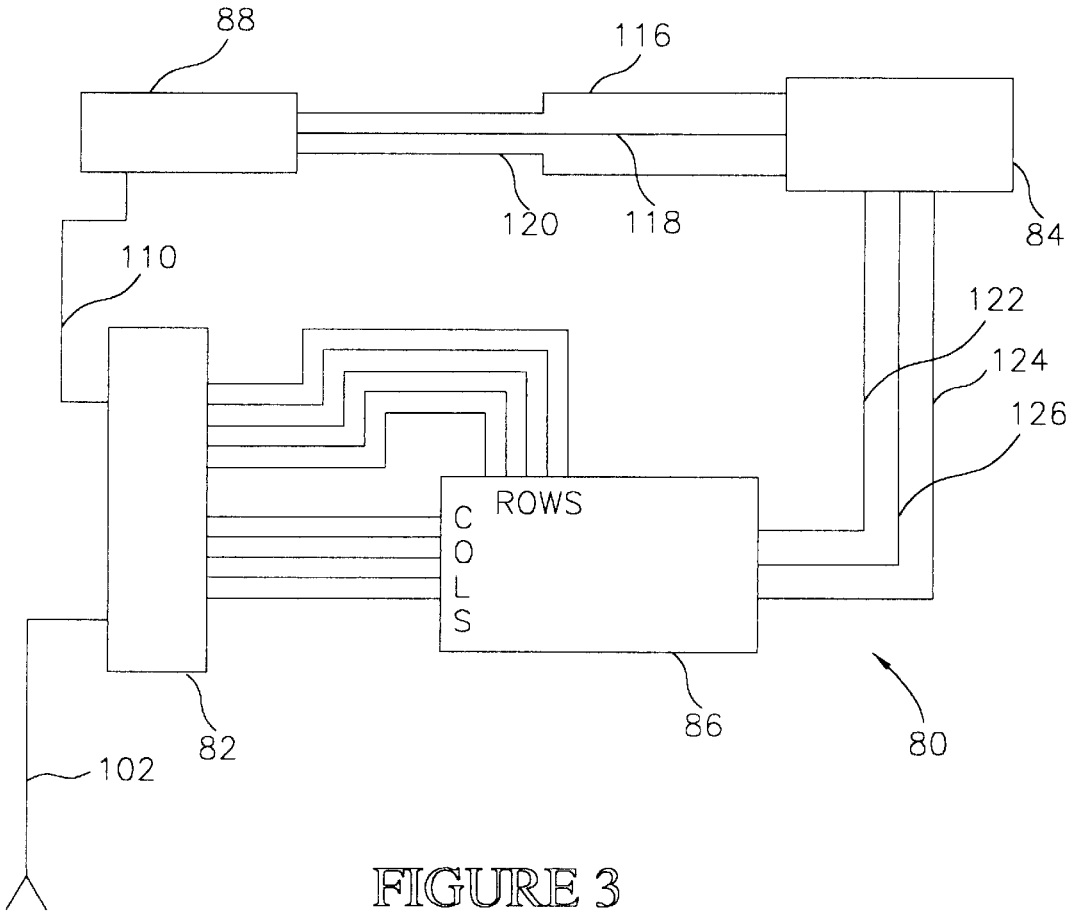
FIG. 3 is an electrical schematic of a control circuit constructed in accordance with an alternate embodiment of the invention wherein the power supply is adapted to provide a high source impedance for preventing emission to grid.

Referring to FIG. 3, an alternate embodiment control circuit 80 for controlling emission to grid during turn on and turn off of a field emission display is shown. The control circuit 80 is constructed to short together all of the emitter sites 13 (FIG. 1A) during a turn on mode (i.e., power up) and turn off mode (i.e., power off). In addition, the control circuit 80 is constructed with a permanent or switchable high source impedance which functions to limit current to an individual emitter site 13 (FIG. 1A) and prevent emission to grid during the turn on and turn off modes.

The control circuit 80 includes a decoder 82 and a power supply 84 in electrical communication with a field emission display 86. The field emission display 86 includes rows and columns of field emitter sites 13 (FIG. 1A) adapted to illuminate a display screen 16 (FIG. 1A). The decoder 82 and power supply 84 are controlled by a logic circuit 88.

The control circuit 88 also includes a multiplexer select line 110 located between the logic circuit 88 and decoder 82. In addition, a high impedance select line 116, an enable grid line 118 and an enable cathode line 120 are located between the logic circuit 88 and power supply 84. An emitter voltage line 122, a cathode voltage line 124 and a grid voltage line 126 are located between the power supply 84 and FED display 86.

The decoder 82 can be operated by the logic circuit 88 to turn on all rows and columns thus setting all of the emitter sites 13 in the "on" condition. The decoder 82 can also be operated by the logic circuit 88 to disable all rows and columns of emitter sites 13 and to select an individual emitter sites 13. A selected emitter site 13 can thus be enabled to illuminate a particular portion of the display screen 16 for the field emission display 86.

Figure 3A:
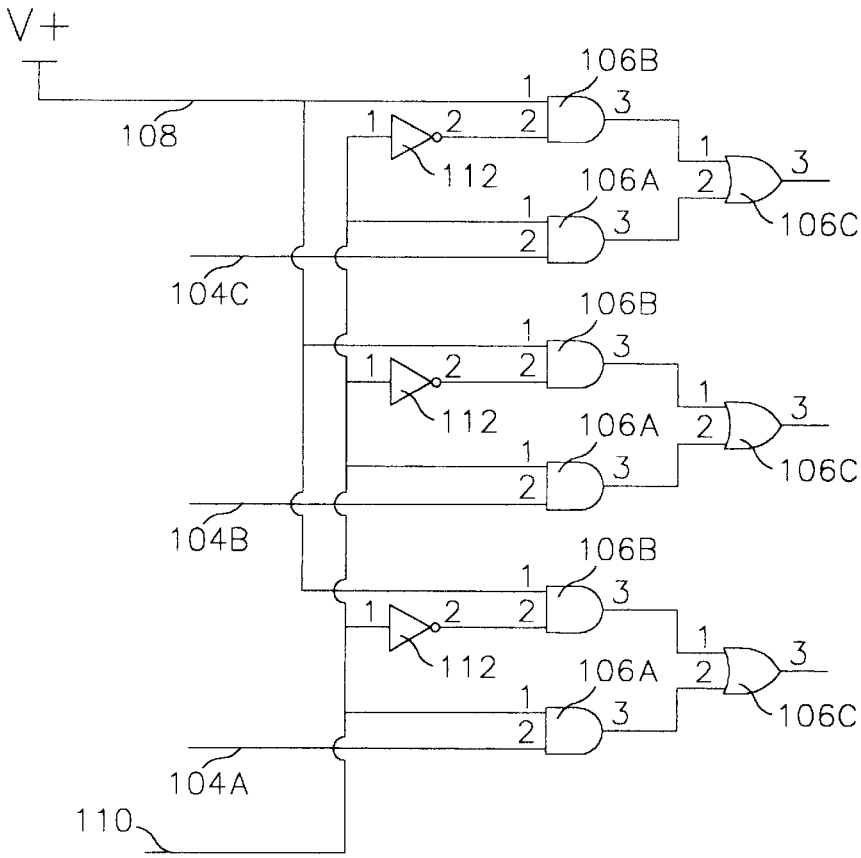
FIG. 3A is an electrical schematic of a multiplexer component for the control circuit shown in FIG. 3.

The decoder 82 is in electrical communication with a row and column address bus 102 for the field emission display. As shown in FIG. 3A, the decoder 82 can include a multiplexer 100 adapted to select all rows and columns of emitter sites 13 in the output circuitry of the decoder 82 or to select a single emitter site 13. In FIG. 3A, three sample rows or columns for the multiplexer are shown.

The multiplexer 100 is basically an and/or circuit that can be constructed in a variety of ways. In the illustrative embodiment, the multiplexer 100 includes row or column address lines 104A, 104B and 104C, in electrical communication with the row and column address bus 102. Each of the row or column address lines 104A, 104B and 104C is in electrical communication with the (#2) inputs of a first set of logic gates 106A (e.g., "and" gates). An "all on" line 108 is in electrical communication with V+ and with the #2 inputs for the first set of logic gates 106A. The "all on" line 108 is also in electrical communication with the (#1) inputs of a second set of logic gates 106B.

In addition, a select line 110 is in electrical communication with the logic circuit 88 (FIG. 3) and the (#1) inputs of logic gates 106A. The select line 110 is also in electrical communication with inverters 112 (e.g., not gates) and the (#2) inputs of logic gates 106B. A third set of logic gates 106C (e.g., or gates) include outputs (3) in electrical communication with the emitter sites 13. The logic gates 106C receive a (#1) input from the outputs (3) of logic gates 106B and a (#2) input from the outputs (3) of logic gates 106B.

The power supply 84 can be constructed with a permanent or a switchable high source impedance having a value for limiting current and preventing emission to grid in any one emitter site 13. With the emitter sites 13 shorted together the high source impedance provides protection against emission to grid because there cannot be enough current flow through an individual emitter site 13 to cause emission to grid. With a switchable power source impedance, the current to the emitter sites 13 can be limited during a turn on mode and then switched to a normal operational mode once the grid and anode voltages have been established and stabilized. This same sequence can be followed during turn off (i.e., emitter sites shorted together, high impedance switched on, power off).

Figure 4A:
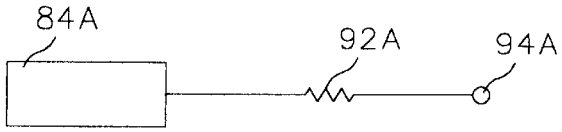
FIG. 4A is an electrical schematic of a power supply component for the control circuit shown in FIG. 3 having a permanently high source impedance.
Figure 5A:
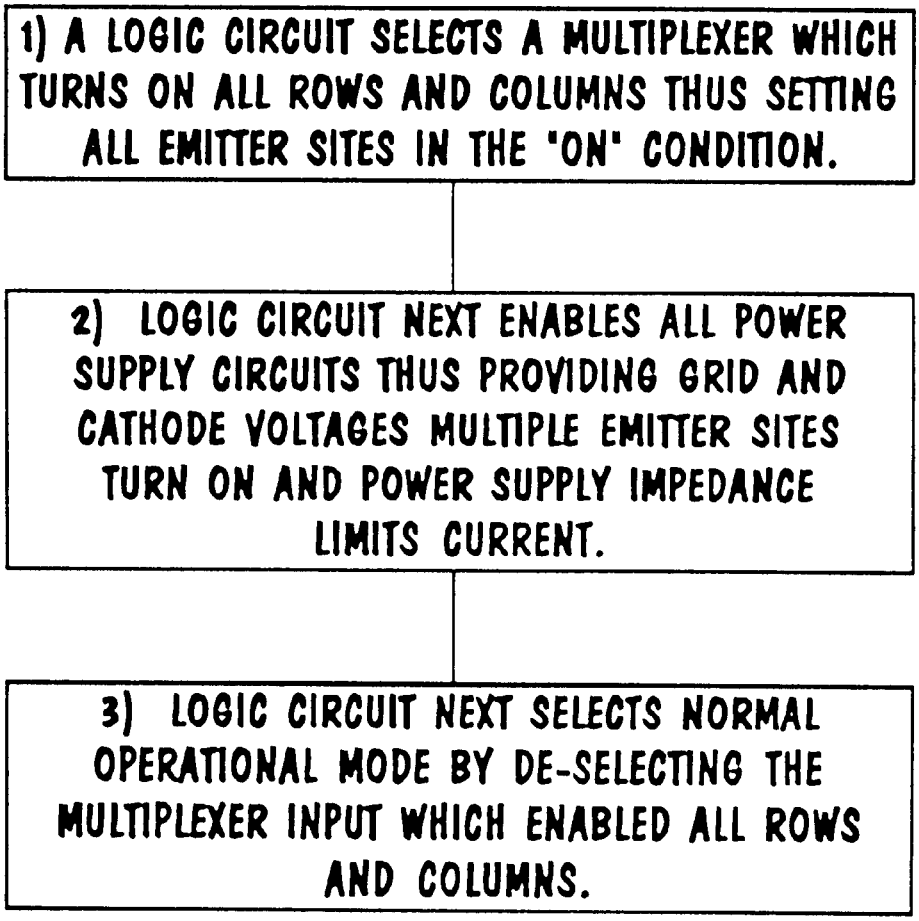
FIG. 5A is a flow diagram of a control sequence for the power supply in FIG. 4A with a permanently high source impedance.

FIGS. 4A illustrates a power supply 84A with a permanent high source impedance 92A and power output 94A. The impedance 92A for the power supply 84A is selected such that with the emitter sites 13 shorted together, there is not enough power to allow emission to grid. A sequence of operation for the control circuit 80 (FIG. 3) having a permanent high source impedance 92A during turn on is summarized in FIG. 5A. This operational sequence begins with the logic circuit 88 (FIG. 3) selecting a multiplexer 100 which turns on all rows and columns of emitter sites 13. All the emitter sites 13 are thus shorted together in the "on" condition during a "turn-on" mode. The logic circuit 88 next enables the power supply 84 thus providing grid and cathode voltages for the field emission display 86. The logic circuit next de-selects the mode of the mulitplexer 100 in which all rows and columns are enabled and enables select emitter sites 13 as required during a "normal" operational mode. The same sequence can be followed in reverse during turn off of the emitter sites 13.

Figure 4B:
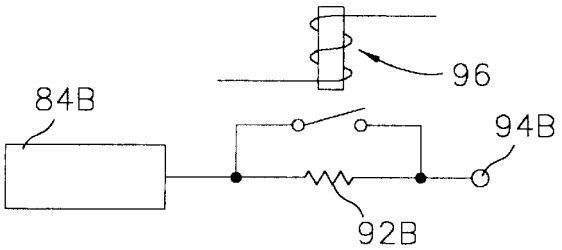
FIG. 4B is an electrical schematic of a power supply component for the control circuit shown in FIG. 3 having a relay switched high source impedance.
Figure 4C:
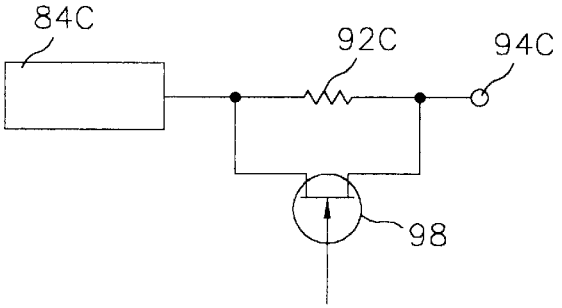
FIG. 4C is an electrical schematic of a power supply component for the control circuit shown in FIG. 3 having a device switched high source impedance.

FIG. 4B illustrates a power supply 84B with a relay switchable high source impedance 92B and power output 94B. The high source impedance 92B is in electrical communication with a relay switch 96. The relay switch 96 is controlled by the logic circuit 88 (FIG. 3) and is adapted to switch the high source impedance 92B on during a turn on mode and then off once the grid voltage has been established. FIG. 4C illustrates a power supply 84C with a device switchable high source impedance 92C. High source impedance 92C can be switched by a switching device 98 (e.g., transistor) controlled by the logic circuit 88 (FIG. 3). In either case (relay switch 96 or switching device 98), the reverse sequence can be followed during turn off.

Figure 5B:
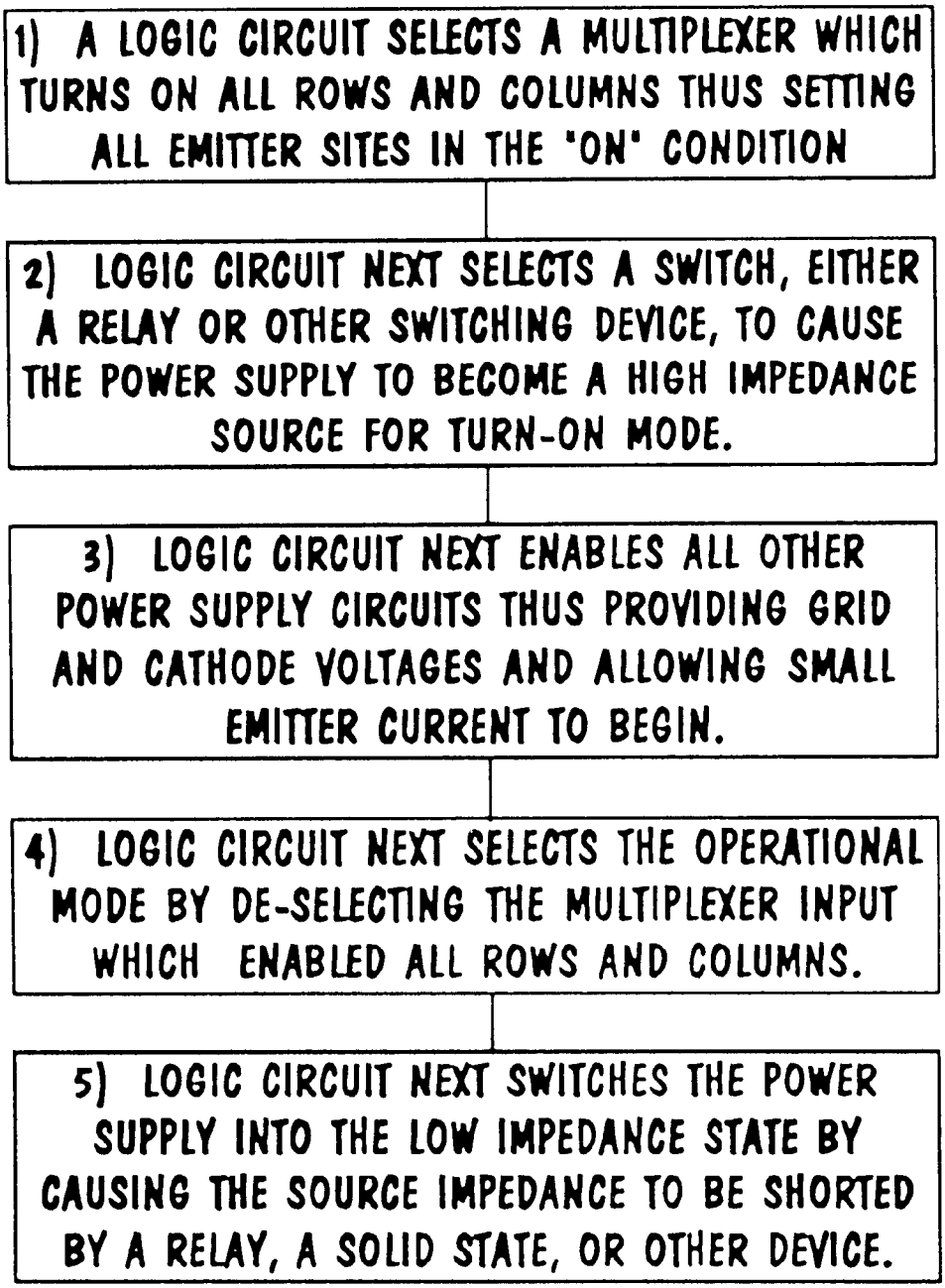
FIG. 5B is a flow diagram of a control sequence for the power supplies in FIGS. 4B or 4C having a switchable high source impedance.

A sequence of operation for turn on of a switchable power supply 84B or 84C is summarized in FIG. 5B. Initially, the logic circuit 88 selects a multiplexer 100 which turns on all rows and columns of emitter sites 13 thus setting all emitter sites 13 in the "on" condition. The logic circuit 88 next selects a relay 96 (FIG. 4B) or a switching device 98. This causes the power supply 84B or 84C to become a high impedance source. The logic circuit 88 next enables all other power supply circuits thus providing grid, cathode and anode voltages and allowing small emitter site currents to begin. The logic circuit 88 next selects the normal operational mode by de-selecting the multiplexer 100 which enabled all rows and columns. The logic circuit 88 next switches the power supply 84B or 84C into the low impedance operational mode by causing the high source impedance 92B or 92C to be shorted by the relay 96 or switching device 98.

Thus the invention provides a method for controlling emission to grid during turn on and turn off of an FED. While the method of the invention has been described with reference to certain preferred embodiments, as will be apparent to those skilled in the art, certain changes and modifications can be made without departing from the scope of the invention as defined by the following claims.

What is claimed is:

1. A method for controlling a field emission display comprising:

providing an emitter site in electrical communication with a power source and configured for electron emission;

providing a grid configured to apply a voltage potential to the grid to initiate the electron emission;

providing a display screen configured to receive the electron emission to form an image;

applying a voltage potential proximate to the emitter site; and enabling the grid to initiate the electron emission in a direction towards the voltage potential and away from the grid.

2. The method of claim 1 wherein applying the voltage potential comprises enabling the display screen.

3. The method of claim 1 wherein enabling the grid is performed with an anode sensing circuit configured to enable the grid when a $V_{Anode}$ is high and to discharge the grid when the $V_{Anode}$ is low.

4. A method for controlling a field emission display comprising:

providing a baseplate comprising an emitter site, and a grid configured to bias the emitter site to initiate an emission of electrons from the emitter site;

providing a display screen configured to receive the electrons to form an image;

applying a voltage potential between the display screen and the emitter site; and initiating electron emission from the emitter site with the electrons attracted by the voltage potential towards the display screen and away from the grid.

5. The method of claim 4 wherein applying the voltage potential comprises establishing a $V_{Anode}$ at the display screen.

6. The method of claim 4 further comprising discharging the grid if a $V_{Anode}$ at the display screen is low.

7. A method for controlling a field emission display comprising:

providing an emitter site in electrical communication with a power source and configured for electron emission;

providing a grid configured to apply a voltage potential to the grid to initiate the electron emission;

providing a display screen configured to receive the electron emission to form an image;

providing a control circuit configured to sense a voltage at the display screen;

applying a voltage potential proximate to the emitter site;

sensing the voltage at the display screen using the control circuit; and enabling the grid to initiate the electron emission in a direction towards the voltage potential and away from the grid provided the voltage at the display screen is above a first level.

8. The method of claim 7 further comprising discharging the grid when the voltage at the display screen is below a second level.

9. The method of claim 7 wherein the voltage at the display screen comprises a $V_{Anode}$ and the first level comprises a high.

10. The method of claim 7 wherein the control circuit comprises a fault detection circuit configured to discharge the grid upon detection of a fault signal.

11. A method for controlling a field emission display comprising:

providing a baseplate comprising an emitter site, and a grid configured to bias the emitter site to initiate an emission of electrons from the emitter site;

providing a display screen configured to receive the electrons to form an image;

providing a detection circuit configured to sense a voltage at the display screen and to provide a high signal and a low signal based upon the voltage at the display screen;

applying a voltage potential between the display screen and the emitter site;

initiating electron emission from the emitter site with the electrons attracted by the voltage potential towards the display screen and away from the grid provided the detection circuit provides the high signal; and discharging the grid provided the detection circuit provides the low signal.

12. The method of claim 11 wherein the detection circuit comprises a peak detector.

13. The method of claim 11 wherein the detection circuit comprises a comparator.

14. The method of claim 11 wherein the detection circuit comprises a Schmitt trigger.

15. The method of claim 11 wherein the detection circuit comprise a logical inverter.

* * * * *